US007871142B2

(12) United States Patent
Benjamin et al.

(10) Patent No.: US 7,871,142 B2
(45) Date of Patent: Jan. 18, 2011

(54) SYSTEMS AND METHODS FOR CONTROLLING INK JET PENS

(75) Inventors: Trudy Benjamin, Portland, OR (US); Kevin Bruce, Corvallis, OR (US); Joseph M. Torgerson, Philomath, OR (US); Matthew A. Shepherd, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 718 days.

(21) Appl. No.: 11/840,445

(22) Filed: Aug. 17, 2007

(65) Prior Publication Data

US 2009/0046117 A1 Feb. 19, 2009

(51) Int. Cl.
*B41J 29/38* (2006.01)

(52) U.S. Cl. ..... 347/12

(58) Field of Classification Search ..... 347/5, 347/9, 10, 12, 14, 57–59
See application file for complete search history.

(56) References Cited

U.S. PATENT DOCUMENTS 5,541,629 A 7/1996 Saunders et al.
6,027,198 A * 2/2000 Tanaka et al. ..... 347/12
6,309,040 B1 10/2001 Norton
7,019,866 B1 3/2006 Beck et al.
7,104,624 B2 9/2006 Schloeman et al.
7,198,348 B2 4/2007 Hu
7,240,981 B2 7/2007 Wade et al.
2005/0237354 A1 * 10/2005 Quintana ..... 347/12
2007/0139454 A1 * 6/2007 Hamasaki et al. ..... 347/12

* cited by examiner

*Primary Examiner*—Julian D Huffman

(57) ABSTRACT

A control circuit is provided for controlling ink jet pens having different numbers of internal select lines using external select lines that extend between the control circuit and the ink jet pens and that are shared by the ink jet pens. In one embodiment, the control circuit includes a register that store values, the values indicating whether a pulse is or is not to be sent as to each of the external select lines, a first control module configured to control select pulses sent on a first external select line after consultation of the register, and a second control module configured to control select pulses sent on a second external select line after consultation of the register.

23 Claims, 11 Drawing Sheets

SYSTEMS AND METHODS FOR CONTROLLING INK JET PENS

BACKGROUND

Ink jet pens typically comprise a printhead that includes an array of precisely formed nozzles in an orifice or nozzle plate that is attached to an ink barrier layer which, in turn, is attached to a thin film substructure that implements ink firing heater resistors and apparatuses for energizing the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and orifice plate that are adjacent the ink chambers.

In some control schemes, the ink jet pens of the type described above are controlled using data lines, address lines, select lines, and fire lines that are used in combination to energize desired heater resistors. Normally, each ink jet pen in the printing device comprises the same number of select lines, thereby enabling similar control over the pens. Currently contemplated, however, are printing devices that use ink jet pens having disparate numbers of select lines. Such implementations create various challenges in relation to ink jet pen control. For example, control must be provided for each type of ink jet pen despite their differences. Furthermore, it may be desirable to optimize performance of each type of ink jet pen individually.

BRIEF DESCRIPTION OF THE DRAWINGS

The disclosed systems and methods will readily be appreciated by persons skilled in the art from the following detailed description when read in conjunction with the drawings. The components in the drawings are not necessarily to scale.

DETAILED DESCRIPTION

As described above, use of different types of ink jet pens in the same printing device presents various challenges. As described below, such challenges can be addressed using a control circuit specifically configured to control ink jet pens having different numbers of select lines.

Figure 1:
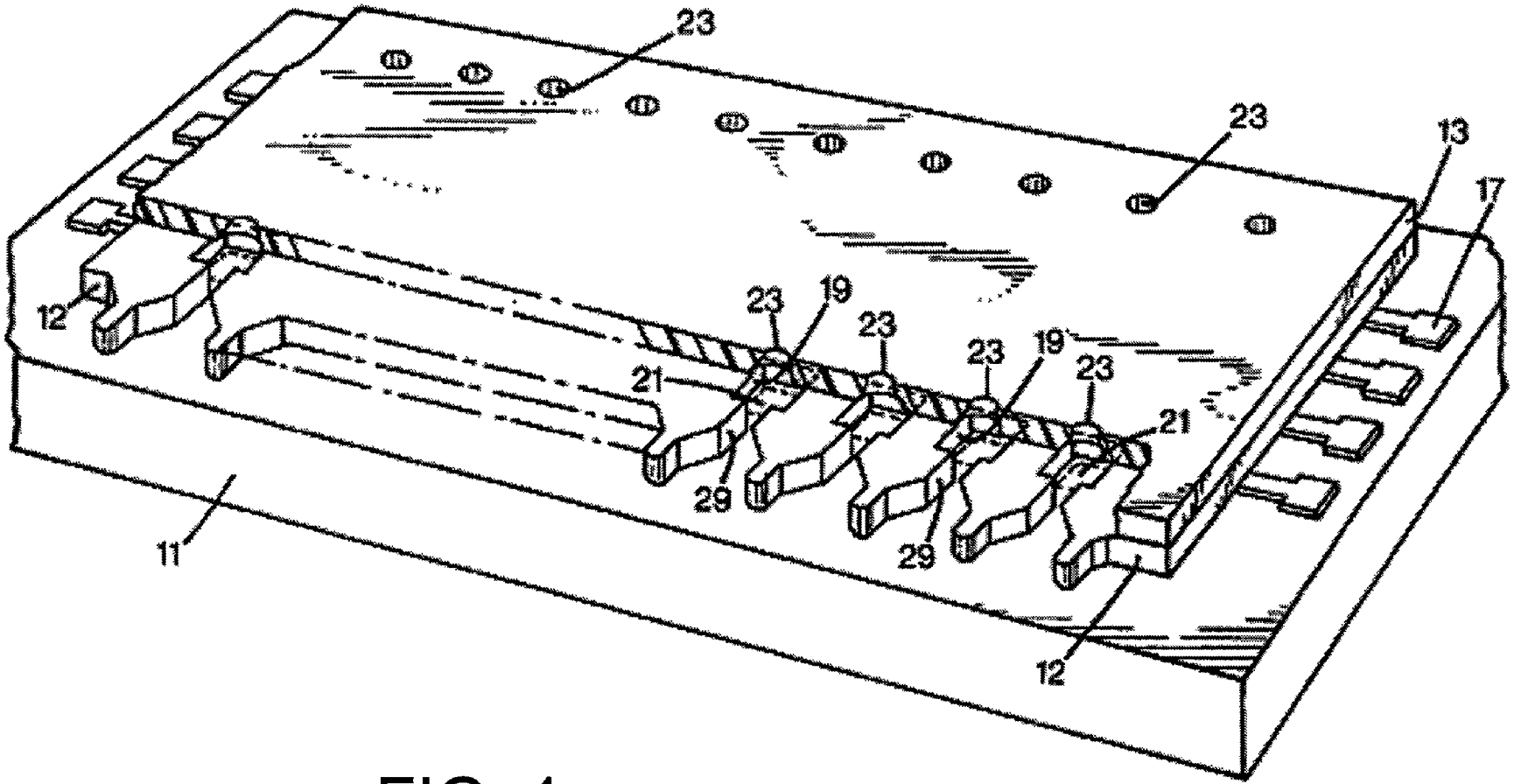
FIG. 1 is a schematic, partially sectioned perspective view of major components of an ink jet printhead.

In the following detailed description and in the several figures of the drawings, like elements are identified with like reference numerals. Referring now to FIG. 1, set forth therein is an unscaled schematic perspective view of an ink jet printhead which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier layer 12.

The thin film substructure 11 is an NMOS integrated circuit that includes ink firing cell circuits each of which includes a dynamic memory element respectively and exclusively associated with a heater resistor 21 which is also formed in the thin film substructure 11. The thin film substructure 11 is formed pursuant to known integrated circuit techniques, for example as disclosed in commonly assigned U.S. Pat. No. 5,635,968 and U.S. Pat. No. 5,317,346, both incorporated herein by reference.

The ink barrier layer 12 is formed of a dry film that is heat and pressure laminated to the thin film substructure 11 and photodefined to form therein ink chambers 19 and ink channels 29 which are disposed over resistor regions which are on either side of a generally centrally located gold layer 15 (FIG. 2) on the thin film substructure 11. Gold bonding or contact pads 17 engagable for external electrical interconnections are disposed at the ends of the thin film substructure and are not covered by the ink barrier layer 12. As discussed further herein with respect to FIG. 2, the thin film substructure 11 includes a patterned gold layer 15 generally disposed in the middle of the thin film substructure 11 between the rows of heater resistors 21, and the ink barrier layer 12 covers most of such patterned gold layer 15, as well as the areas between adjacent heater resistors 21. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the Riston brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate 13 can also comprise a plated metal such as nickel.

The ink chambers 19 in the ink barrier layer 12 are more particularly disposed over respective ink firing resistors 21, and each ink chamber 19 is defined by the edge or wall of a chamber opening formed in the barrier layer 12. The ink channels 29 are defined by further openings formed in the barrier layer 12, and are integrally joined to respective ink firing chambers 19. By way of illustrative example, FIG. 1 illustrates an outer edge fed configuration wherein the ink channels 29 open towards an outer edge formed by the outer perimeter of the thin film substructure 11 and ink is supplied to the ink channels 29 and the ink chambers 19 around the outer edges of the thin film substructure, for example as more particularly disclosed in commonly assigned U.S. Pat. No. 5,278,584, incorporated herein by reference. The invention can also be employed in a center edge fed ink jet printhead such as that disclosed in previously identified U.S. Pat. No. 5,317,346, wherein the ink channels open towards an edge formed by a slot in the middle of the thin film substructure.

The orifice plate 13 includes orifices 23 disposed over respective ink chambers 19, such that an ink firing resistor 21, an associated ink chamber 19, and an associated orifice 23 are aligned. An ink firing cavity or ink drop generator region is formed by each ink chamber 19 and portions of the thin film substructure 11 and the orifice plate 13 that are adjacent the ink chamber 19.

Figure 2:
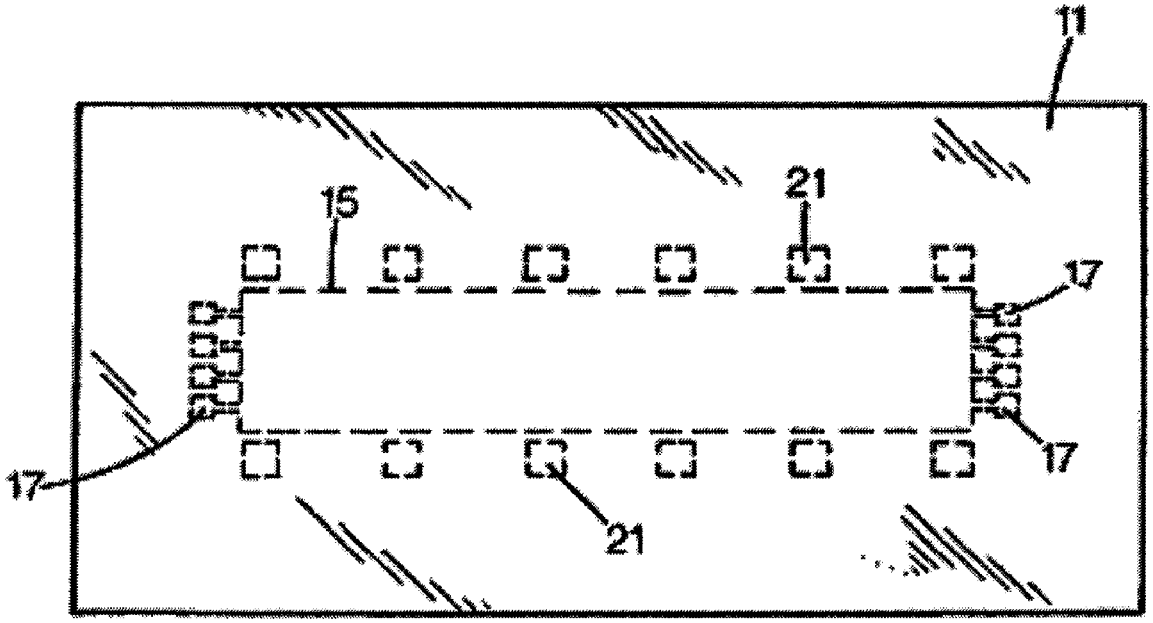
FIG. 2 is a schematic top plan illustration of the general layout of the thin film substructure of the ink jet printhead of FIG. 1.

Referring now to FIG. 2, set forth therein is an unscaled schematic top plan illustration of the general layout of the thin film substructure 11. The ink firing resistors 21 are formed in resistor regions that are adjacent the longitudinal edges of the thin film substructure 11. A patterned gold layer 15 comprised of gold traces forms the top layer of the thin film structure in a gold layer region located generally in the middle of the thin film substructure 11 between the resistor regions and extending between the ends of the thin film substructure 11. Bonding pads 17 for external electrical interconnections are formed in the patterned gold layer 15, for example adjacent the ends of the thin film substructure 11. The ink barrier layer 12 is defined so as to cover all of the patterned gold layer 15 except for the bonding pads 17, and also to cover the areas between the respective openings that form the ink chambers and associated ink channels. Depending upon implementation, one or more thin film layers can be disposed over the patterned gold layer 15.

While FIGS. 1 and 2 generally depict a roof-shooter type of ink jet printhead, it will be appreciated that the disclosed invention can be employed in any type of ink jet printhead that includes heater resistors, including side-shooter type ink jet printheads. It should also be appreciated that the disclosed invention can be employed in an ink jet printhead that prints a plurality of different colors.

Figure 3:
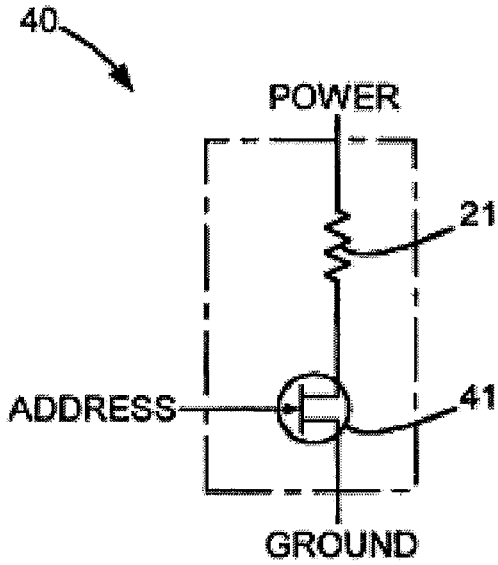
FIG. 3 PRIOR ART
FIG. 3 is a schematic diagram of an ink firing cell of the ink jet printhead of FIG. 1.

FIG. 3 sets forth a schematic representation of a prior art firing cell 40 that has been employed in thermal inkjet printheads. Transfer of energizing energy to the heater resistor 21 is selectively controlled by enabling or disabling a drive or gating transistor 41. For convenience, transfer of energizing energy to a heater resistor is sometimes referred to as firing or energizing the heater resistor.

Figure 3A:
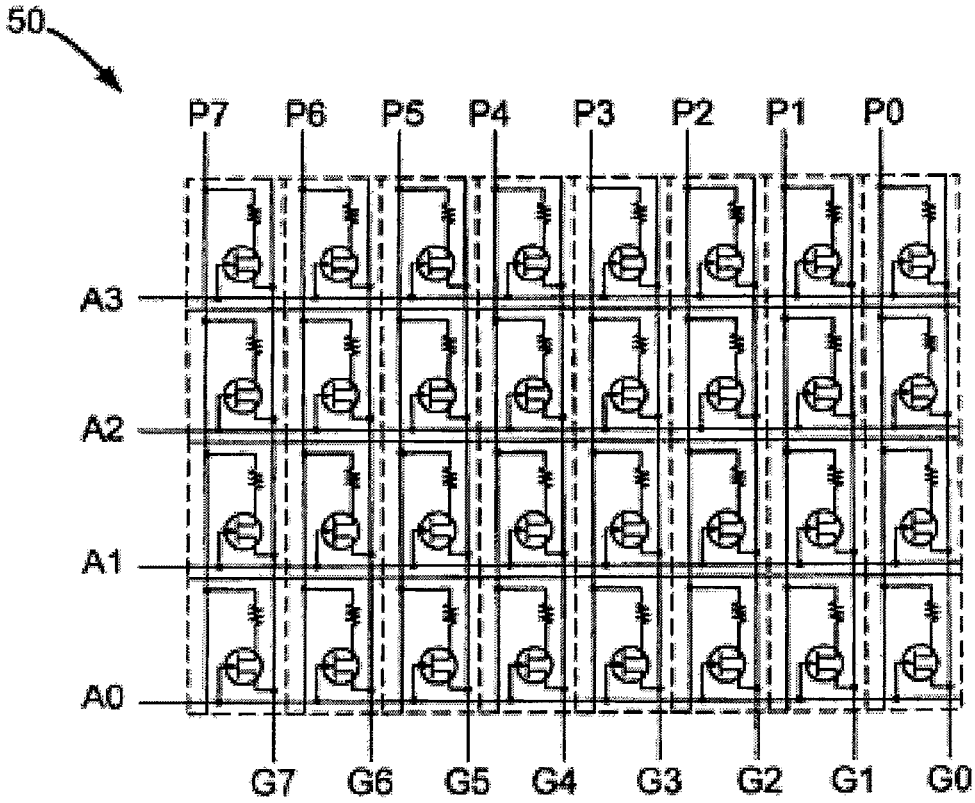
FIG. 3A PRIOR ART
FIG. 3A is a schematic layout of an ink jet ink firing array employing a plurality of ink firing cells of FIG. 3.

FIG. 3A sets forth an array 50 of prior art firing cells 40. The firing cells are schematically interconnected such that all of the drive transistors in a single row of the array of firing cells are selected by a shared one of address lines A0-A3. All heater resistors in a single column of the array of firing cells are connected to a shared one of power lines P0-P7, and the sources of all drive transistors in a single column are connected to a shared one of ground lines G0-G7. Only one address line is enabled at any one time allowing only the heater resistors in the associated row of firing cells to be energized or fired at the same time. Each power line is switched or energized selectively depending upon whether or not the selected firing cell in the associated column is to be activated. Each row of firing cells is addressed and energized sequentially.

Optimally, the matrix or array of firing cells would be square in order to have a minimum number of external interconnections to the array. Mathematically, this minimum number of interconnections can be expressed as 2*SQRT(N) where N is the number of firing cells. However due to system requirements, the matrix is typically not square, but is instead rectangular and the resulting number of interconnections is larger than 2*SQRT(N). The determining factors include the maximum rate at which any resistor can be successively energized (firing rate) and the time it takes to prepare and energize (or fire) each row of heater resistors (firing cycle).

The time from the start of firing any given row of heater resistors to the start of firing of the next successive row of heater resistors is equal to the firing cycle. The reciprocal of the time required to fire all of the rows in an array is equal to the maximum firing rate. Note that the number of columns is independent of the maximum firing rate and the firing cycle.

To increase the number of nozzles on a printhead without changing the basic system parameters of maximum firing rate and firing cycle, the number of rows must stay the same which means the number of columns must increase. If both the number of nozzles and the maximum firing rate increase, then the number of rows must decrease along with the increase in number of columns. This can result in very large increases in the total number of external interconnections needed for a given firing array.

Figure 4:
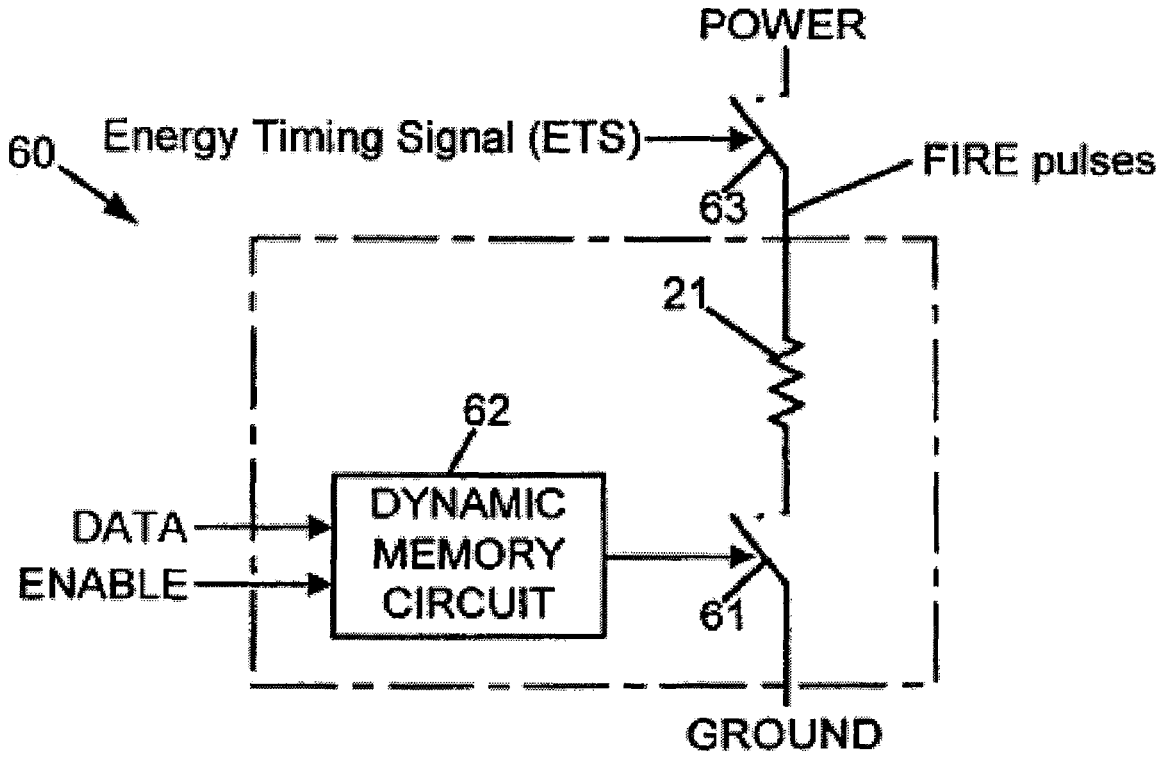
FIG. 4 is a schematic block diagram of a dynamic memory based ink firing cell.

Referring now to FIG. 4, associated with each of the ink firing cavities of the printhead of FIGS. 1 and 2 is a dynamic memory based ink firing cell 60 that generally includes a heater resistor 21, a resistor drive switch 61 connected between one terminal of the heater resistor 21 and ground, and a dynamic memory circuit 62 that controls the state of the resistor drive switch 61, all of which are formed in the thin film substrate 11. Heater resistor energizing energy in the form of fire pulses (also called ink firing pulses) is made available to the heater resistor 21 by a power switch 63 that is controlled by an energy timing signal (ETS) and connected between a power source and the other terminal of the heater resistor 21. The dynamic memory circuit 62 is configured to store one bit of heater resistor energizing binary data that sets the resistor drive switch 61 to a desired state (e.g., on or off, or conductive or non-conductive) prior to the occurrence of a fire pulse. If the resistor drive switch 61 is on (i.e., conductive), the fire pulse energy will be transferred to the heater resistor 21. In other words, the resistor drive switch 61 is controlled by the dynamic memory circuit 62 to enable the transfer of a fire pulse to the heater resistor 21.

The dynamic memory circuit 62 more particularly receives DATA information and ENABLE information that enables the dynamic memory circuit to receive and store the DATA information. For convenience, such enabling of the dynamic memory circuit is sometimes referred to as selection or addressing of the memory circuit or the firing cell. As described further herein, the ENABLE information can include a SELECT control signal and/or one or more ADDRESS control signals.

Figure 5:
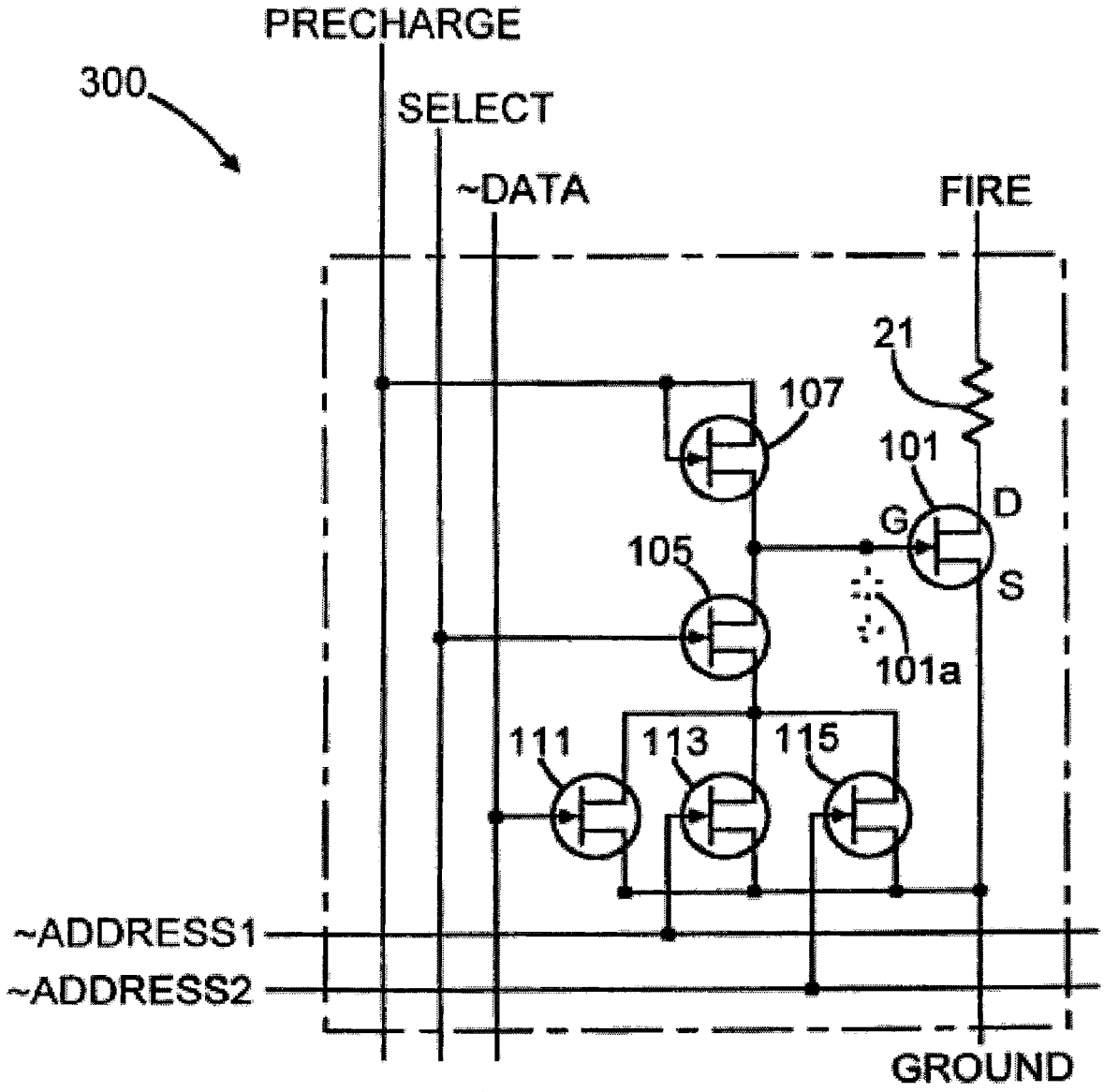
FIG. 5 is a schematic circuit diagram of an example of a precharged dynamic memory based ink firing cell.

Referring now to FIG. 5, set forth therein is a schematic diagram of an illustrative implementation of a precharged dynamic memory ink firing cell 300. The firing cell 300 includes an N-channel drive field effect transistor (FET) 101 for driving a heater resistor 21. The drain of the drive transistor 101 is connected to one terminal of the heater resistor 21, while the source of the drive transistor 101 is connected to a common reference voltage such as ground. The other terminal of the heater resistor 21 receives a heater resistor energizing FIRE signal that comprises ink firing pulses. Firing pulse energy is transferred to the heater resistor 21 if the drive transistor 101 is on at the time the firing pulse is present.

The gate of the drive transistor 101 forms a storage node capacitance 101*a* that functions as a dynamic memory element that stores data pursuant to the sequential activation of a precharge transistor 107 and a select transistor 105. The storage node capacitance 101*a* is shown in dashed lines since it is actually part of the drive transistor 101. Alternatively, a capacitor separate from the drive transistor 101 can be used as a dynamic memory element.

The precharge transistor 107 more particularly receives a PRECHARGE select signal on its drain and gate that are tied together. The select transistor 105 receives a SELECT signal on its gate.

A data transistor 111, a first address transistor 113, and a second address transistor 115 are discharge transistors connected in parallel between the source of the select transistor 105 and ground. Thus, the parallel connected discharge transistors are in series with the select transistor, and the serial circuit comprised of the discharge transistors and the select transistor are connected across the gate capacitance 101*a* of the drive transistor 101. The data transistor 111 receives a firing ~DATA signal, the first address transistor 113 receives an ~ADDRESS1 control signal, and the second address transistor 113 receives an ~ADDRESS2 control signal. These signals are active when low, as indicated by the tilde (~) at the beginning of the signal name.

In the ink firing cell of FIG. 5, the select transistor 105, the precharge transistor 107, data transistor 111, the address transistors 113, 115, and the gate capacitance 101*a* effectively form a dynamic memory data storage cell.

In operation, the gate capacitance 101*a* is precharged by the precharge transistor 107. The ~DATA, ~ADDRESS1 and ~ADDRESS2 signals are then set up, and the select transistor 105 is turned on. If it is desired that the gate capacitance be not charged, at least one of the discharge transistors comprised of the data transistor 111 and the address transistors 113, 115 will be on. If it is desired that the gate capacitance remain charged, the discharge transistors comprised of the data transistor 111 and the address transistors 113, 115 will be off. In particular if the cell is not an addressed cell which is indicated by either ~ADDRESS1 or ~ADDRESS2 being high (i.e., either being de-asserted), the gate capacitance 101*a* is discharged regardless of the state of ~DATA. If the cell is an addressed cell which is indicated by both ~ADDRESS1 and ~ADDRESS2 being low, the gate capacitance 101*a* (a) remains charged if ~DATA is low (i.e., active) or (b) discharged if ~DATA is high (i.e., inactive).

Effectively, the gate capacitance 101*a* is precharged and is not actively discharged only if the ink firing cell is an addressed cell and if the firing data provided to it is asserted. The first and second address transistors 113, in 115 comprise address decoders, while the data transistor 111 controls the state of the gate capacitance when the ink firing cell is addressed.

In the firing cell of FIG. 5, since the data transistor 111 and at least one of the address transistors 113, 115 actively pulls down the gate of the drive transistor 101 when the cell is addressed and the firing data is low (i.e., the heater resistor should not be energized), or at least one of the address transistors actively pulls down the gate of the drive transistor 101 when the cell is not addressed, a clamp transistor to prevent the parasitic charging of the dynamic memory node can be avoided by overlapping the start of a FIRE pulse with a data cycle which is the time interval during which ~ADDRESS1, ~ADDRESS2 and ~DATA are valid and SELECT is active. It should be appreciated that when ~ADDRESS1, ~ADDRESS2 or ~DATA are de-asserted, the transistor receiving the respective signal is conductive. If desired, however, a clamp transistor can be connected between the drain and gate of the drive transistor 101.

Figure 5A:
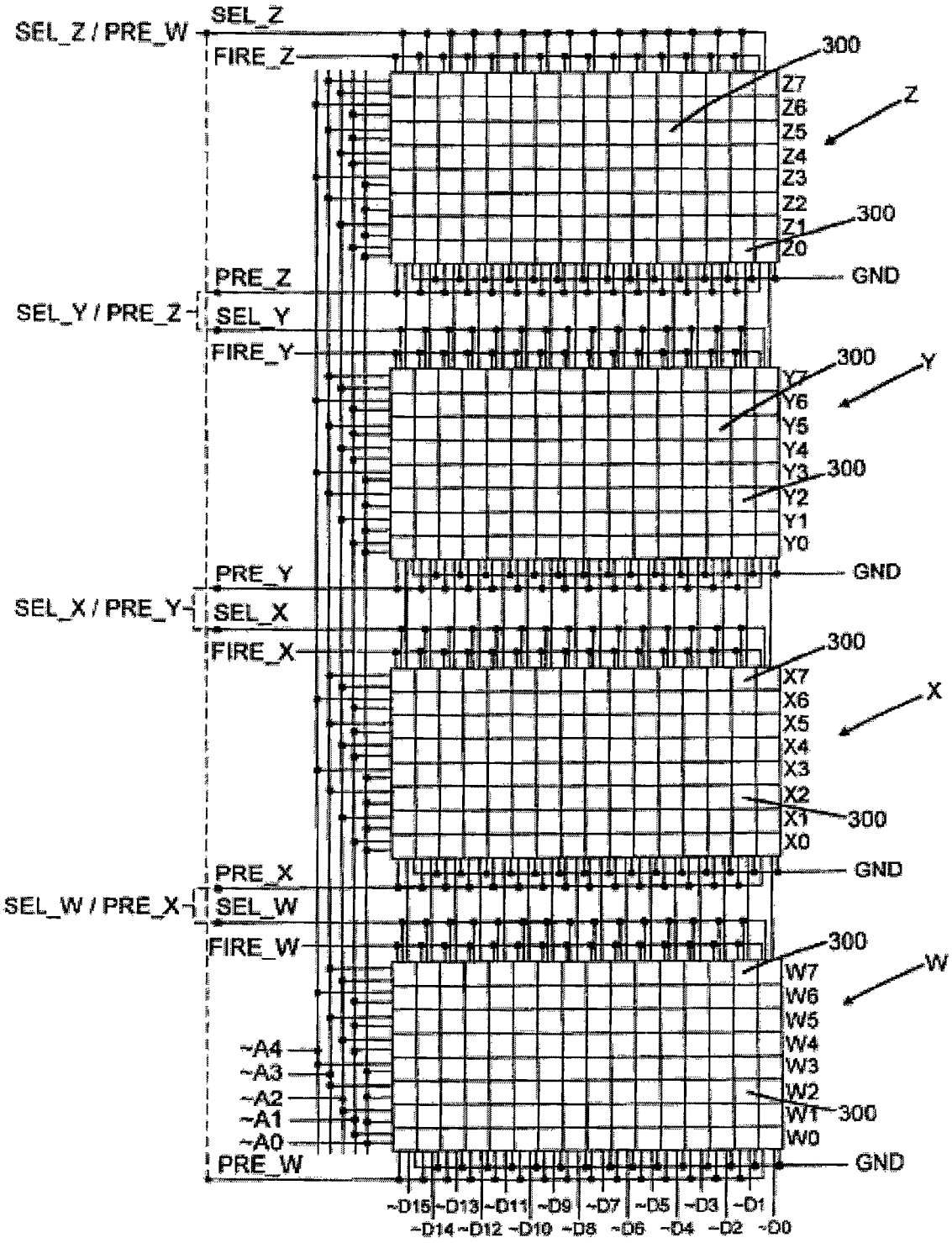
FIG. 5A is a schematic layout of an ink jet ink firing array employing a plurality of ink firing cells of FIG. 5.

Referring now to FIG. 5A, set forth therein is a schematic layout of an ink jet ink firing array employing a plurality of precharged dynamic memory based ink firing cells 300 of FIG. 5 that are arranged in four fire groups W, X, Y, Z, wherein the ink firing cells are arranged in rows and columns in each of the fire groups. For reference, the rows of the respective fire groups W, X, Y and Z are respectively identified as rows W0 through W7, X0 through X7, Y0 through Y7 and Z0 through Z7. As with the arrays of FIGS. 5A and 6A, it is convenient to refer to the rows of firing cells as address rows or subgroups of firing cells, whereby each fire group is comprised of a plurality of subgroups of firing cells.

Firing DATA signals are applied to data lines ~D0 through ~D15 that are associated with respective columns of all of the firing cells, and are connected to external control data circuitry by appropriate interface pads. Each of the data lines is connected to all of the gates of the data transistors 111 of the ink firing cells 300 in an associated column, and each firing cell is connected to only one data line. Thus, each of the data lines provides energizing data to firing cells in multiple rows in multiple fire groups.

ADDRESS control signals are applied to address control lines ~A0 through ~A4 that are connected to the first and second address transistors 113, 115 of the cells of the rows of the array as follows: ~A0, ~A1: rows W0, X0, Y0 and Z0 ~A0, ~A2: rows W1, X1, Y1 and Z1 ~A0, ~A3: rows W2, X2, Y2 and Z2 ~AC, ~A4: rows W3, X3, Y3 and Z3 ~A1, ~A2: rows W4, X4, Y4 and Z4 ~A1, ~A3: rows W5, X5, Y5 and Z5 ~A1, ~A4: rows W6, X6, Y6 and Z6 ~A2, ~A3: rows W7, X7, Y7 and Z7

In this manner, rows of firing cells are addressed by suitable set up of the address control lines ~A0 through ~A4. The address control lines are connected to external control circuitry by appropriate interface pads.

PRECHARGE signals are applied via precharge select control lines PRE_W, PRE_X, PRE_Y and PRE_Z that are associated with the respective fire groups W, X, Y and Z, and are connected to external control circuitry by appropriate interface pads. Each of the precharge lines is connected to all of the precharge transistors 107 in the associated fire group, and all firing cells in a fire group are connected to only one precharge line. This allows the state of the dynamic memory elements of all firing cells in a fire group to be set to a known condition prior to data being sampled.

In SELECT signals are applied via select control lines SEL_W, SEL_X, SEL_Y and SEL_Z that are associated with the respective fire groups W, X, Y and Z, and are connected to external control circuitry by appropriate interface pads. Each of the select control lines is connected to all of the select transistors 105 in the associated fire group, and all firing cells in a fire group are connected to only one select line.

Thus, each row or subgroup of firing cells is connected to a common subset of the address and select control lines, namely the address control lines for the row position of the subgroup as well as the precharge select control line and the select control line for the fire group of the subgroup.

Heater resistor energizing FIRE signals are applied via fire lines FIRE_W, FIRE_X, FIRE_Y and FIRE_Z that are associated with the respective fire groups W, X, Y and Z, and each of the fire lines is connected to all of the heater resistors in the associated fire group. The fire lines are connected to external supply circuitry by appropriate interface pads, and all cells in a fire group share a common ground.

The PRECHARGE pulse is sent prior to set up of the ADDRESS signals and assertion of the SELECT signal. The PRECHARGE pulse defines a precharge time interval while the SELECT signal defines a discharge time interval. Heater resistor energizing data is stored in the array one row of firing cells at time, one fire group at a time.

Since the fire groups are selected iteratively and since for each fire group a precharge pulse precedes a fire pulse, the select line for a particular fire group can be connected to the precharge line for the prior in-sequence in fire group to form combined control lines SEL_W/PRE_X, SEL_X/PRE_Y, SEL_Y/PRE_Z and SEL_Z/PRE_W, as shown in dashed lines in FIG. 5A, and that a combined SELECT/PRECHARGE signal can be utilized for each of the combined control lines.

A timing diagram of an illustrative example of the operation of the array of FIG. 5A for the particular example wherein the SELECT control line for a particular fire group is connected to the PRECHARGE line for the prior in-sequence firing group is provided in U.S. Pat. No. 6,439,697, which is hereby incorporated by reference.

Figure 6:
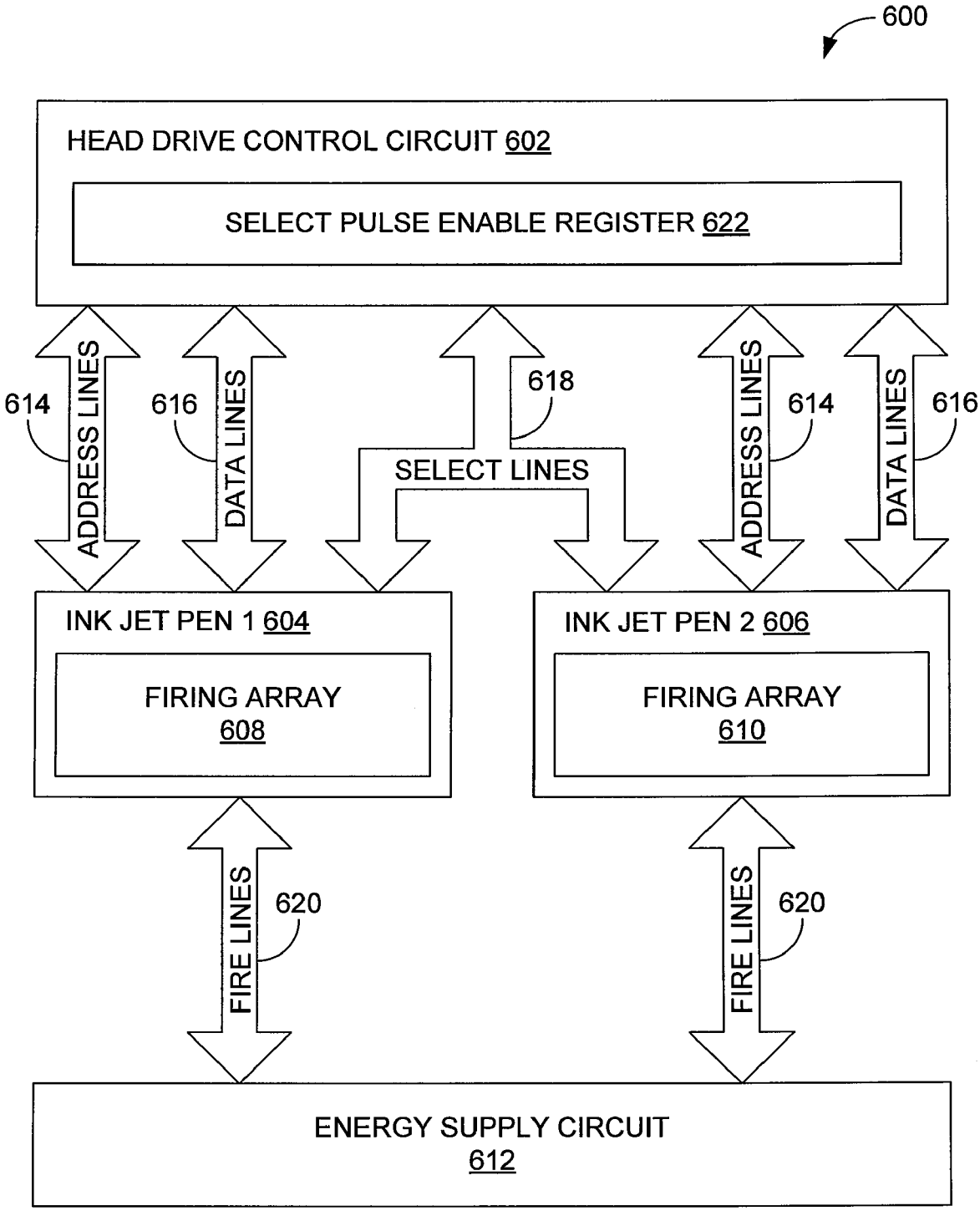
FIG. 6 is a schematic block diagram of an embodiment of printer system configured to simultaneously control ink jet pens of different types.

Referring now to FIG. 6, set forth therein is a simplified block diagram of a printer system 600. As indicated in FIG. 6, the printer system 600 includes a head drive control circuit 602 that controls first and second ink jet pens 604 and 606, which comprise different numbers of internal select lines. By way of example, the first ink jet pen 604 is a multi-color ink jet pen that comprises 7 internal select lines and the second ink jet pen 606 is a single color (e.g., black) ink jet pen that comprises 5 internal select lines. Notably, the pens 604, 606 may comprise other numbers of select lines. As indicated in FIG. 6, each pen 604, 606 comprises a firing array 608, 610.

The head drive control circuit 602 provides address, select, and data control signals to the ink jet pens 604, 606, and further controls an energy supply circuit 612 that provides heater resistor energizing fire signals to the pens. The address and data control signals are provided to the pens 604, 606 along separate address and data lines 614 and 616, and the fire signals are provided to the pens 604, 606 using separate fire lines 620. In contrast, the select control signals are provided to both of the pens 604, 606 using the same external select lines 618. Therefore, as described in the following, the head drive control circuit 602 is configured to control multiple pens having different numbers of internal select lines using the same select lines that extend between the head drive control circuit and the pens such that both pens receive the same select timing. Moreover, in some embodiments, the first ink jet pen 604 can be operated in an overlap mode in which the first and previous last select pulses coincide or "overlap" in time so as to enable faster printing. In such embodiments, the head drive control circuit 602 is configured to enable such overlap operation for the first ink jet pen without imposing such a control scheme on the second ink jet pen 606. It is noted that, in some embodiments, each pen 604, 606 has its own address generator. In such embodiments, address lines 614 are omitted.

As is further illustrated in FIG. 6, the head drive control circuit 602 includes a select pulse enable register 622, SelPulseEn, that is used in the control process. In some embodiments, the register 622 includes 7 bits: Bits 0-6. If a bit is set (e.g., has a value of "1"), a select pulse will occur on the external select line associated with that bit. Therefore, to consider an example, if a "1" is stored in Bit 0 of the register 622, a pulse will be sent out on external select line 0, or "Select0." Through control over the bits of the select pulse enable register 622, independent control can be simultaneously exercised over the ink jet pens 604, 606. When both pens 604, 606 are to be run, 7 select pulses must be accounted for. If a select pulse is to be sent on each of the select lines, all of the bits are set, such that the register values are "111_1111" or SelPulseEn='b111_1111. Notably, setting of Select0 (Bit 0=1) can, in some embodiments, facilitate overlap operation, for example for the first ink jet pen 604. In cases in which only pen 606 is to be run (e.g., when only printing in black) only 5 select pulses must be sent and only a subset of 5 bits of the total 7 are set. For example, the select pulse enable register values can be set as "011_1110" or SelPulseEn='b011_1110. Use of the select pulse enable register 622 and its bit values are described in further detail below in relation to FIGS. 8A-8C.

Figure 7:
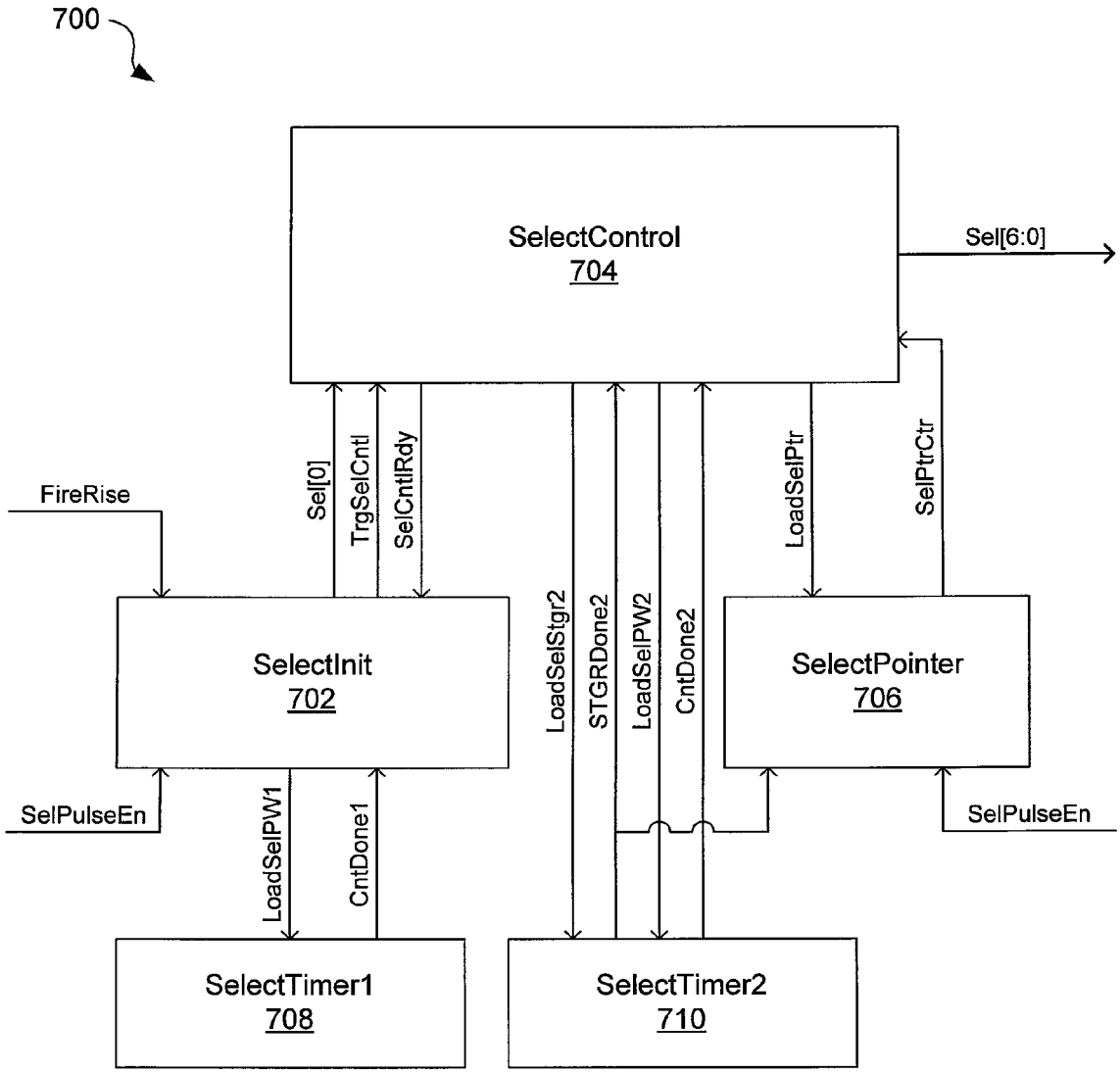
FIG. 7 is a block diagram of an example embodiment for a head drive control circuit shown in FIG. 6.

FIG. 7 illustrates an example embodiment 700 for the head drive control circuit shown in FIG. 6. The head drive control circuit 700 of FIG. 7 includes a select initiate module 702 ("SelectInit"), a select control module 704 ("SelectControl"), a select pointer 706 ("SelectPointer"), a first select timer 708 ("SelectTimer"), and a second select timer 710 ("SelectTimer2"). In some embodiments, each of SelectInit 702, SelectControl 704, and SelectPointer 706 comprises a state machine that contributes in the generation of select pulses that are sent to ink jet pens. SelectInit 702, SelectControl 704, and SelectPointer 706 may comprise hardware, software, firmware or combinations thereof and therefore comprise the logic that controls select pulse generation. In some embodiments, SelectInit 702, SelectControl 704, and SelectPointer 706 as well as the timers 708 and 710, each comprise a portion of an application-specific integrated circuit (ASIC) that embodies the head drive control circuit 700.

SelectInit 702, responsive to an initiation signal, starts new timeslots (described below) and, therefore, operation of the head drive control circuit 700 when a new firing cycle is to begin. In addition, SelectInit 702 generates select pulses for first select line, Select0, and therefore controls enabling or disabling of overlap operation of one or more of the ink jet pens (e.g., ink jet pen 604, FIG. 6). As mentioned above, when overlap operation is enabled, the first and previous last select pulses (e.g., pulses sent on Select0 and Select6) coincide or "overlap" in time so as to increase print speed.

While SelectInit 702 generates select pulses for the first select line, Select0, SelectControl 704 generates select pulses for the other select lines, for example Select1-Select6. When the second-to-last select pulse (e.g., Select5) has been sent, SelectControl 704 signals SelectInit 702 so that SelectInit can start a new timeslot and, if indicated by the select pulse enable register 622, send a new select pulse on Select0 to coincide with the select pulse to be sent on Select6 by SelectControl.

SelectPointer 706 refers to the select pulse enable register 622 to determine which select lines are to receive pulses and generates pointers that point to select pulses that are to be sent. In some embodiments, SelectPointer 706 only looks to the bits that follow the first bit, for example Bits 1-6, and therefore only identifies select pulses for SelectControl 704. In such embodiments, SelectInit 702 determines the value in bit 0 and, therefore, makes its own determination as to whether a select pulse is to be sent on Select0.

Figure 8A:
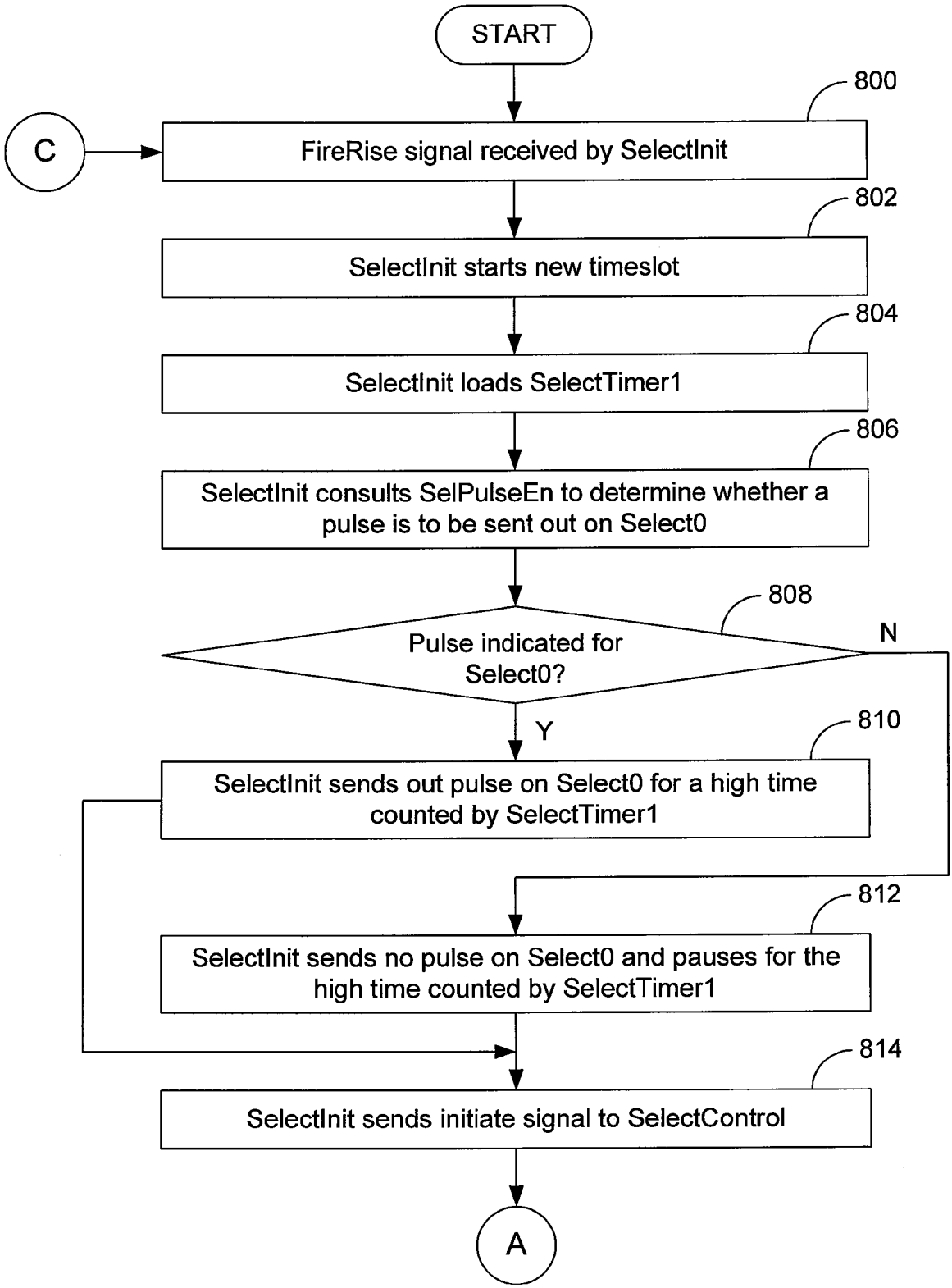
FIGS. 8A-8C comprise a flow diagram of an embodiment of a method for controlling ink jet pens.
Figure 8B:
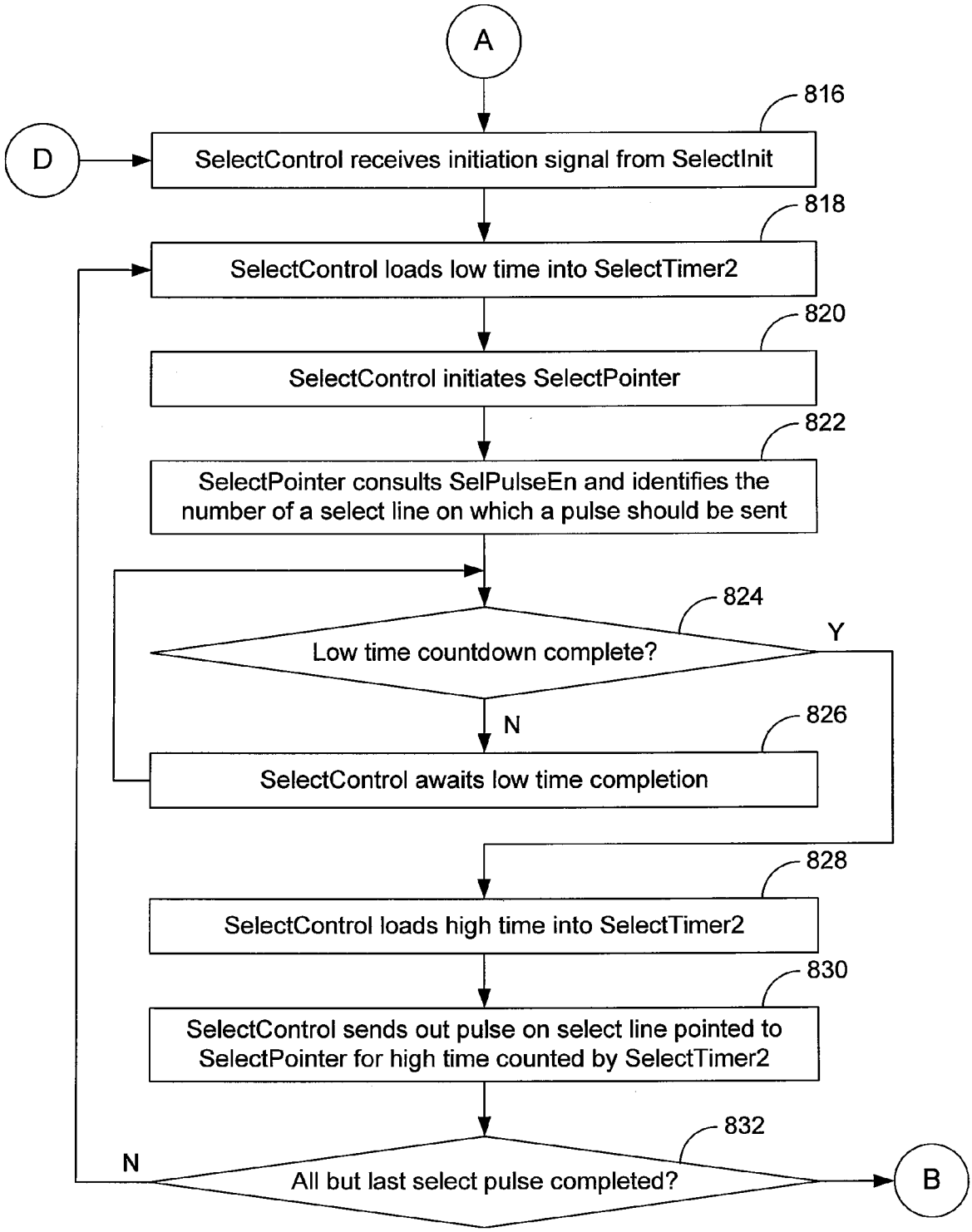
Figure 8C:
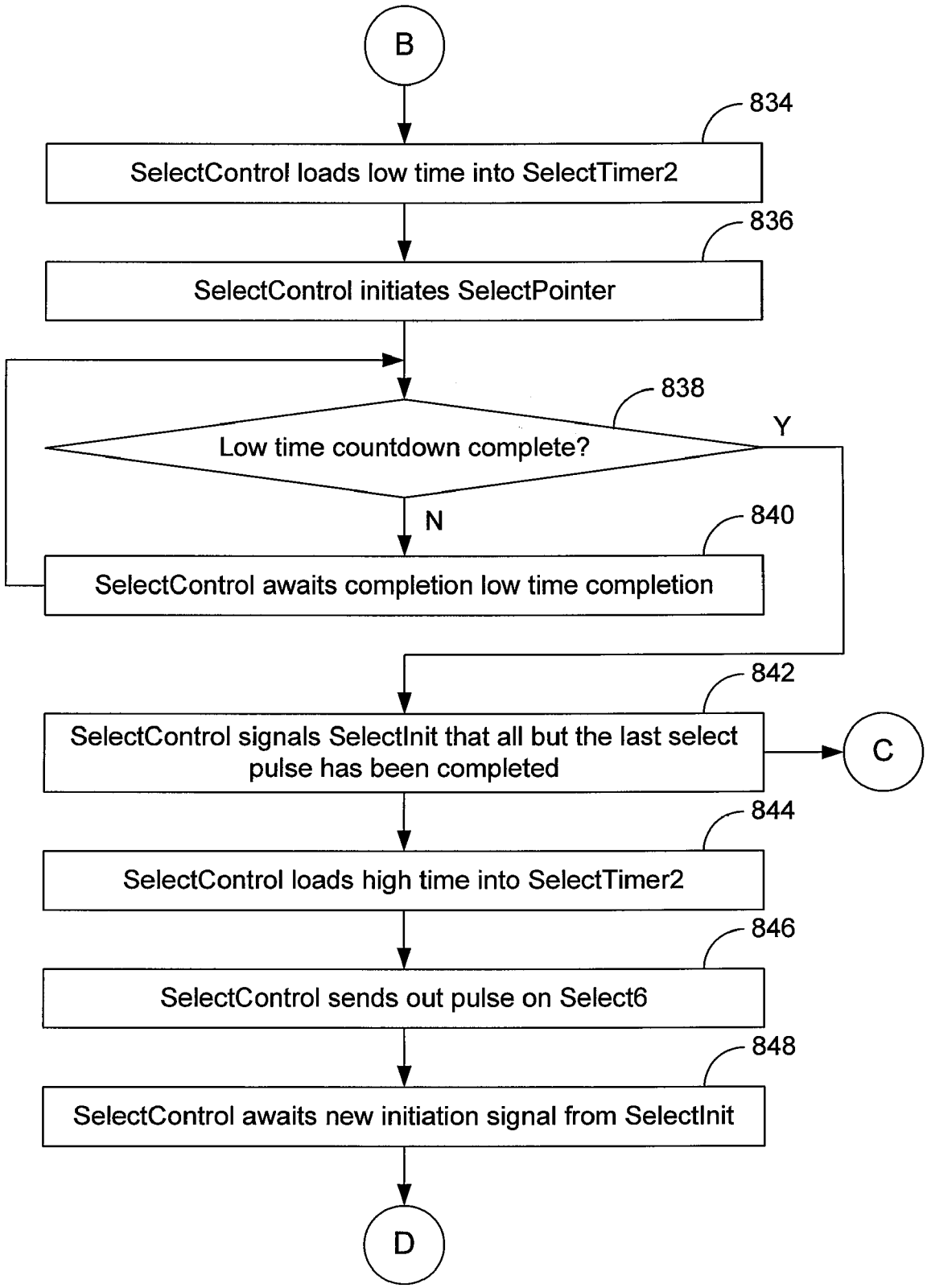

FIGS. 8A-8C describe an example method of controlling ink jet pens. More particularly, FIGS. 8A-8C presents an example of operation of the head drive control circuit 700 of FIG. 7 in generating select pulses for the ink jet pens. Beginning with block 800 of FIG. 8A, a FireRise signal is received by SelectInit 702. The FireRise signal is a pulse that indicates the start of a new timeslot during which nozzles will be fired. In some embodiments, the FireRise signal is generated by an encoder of the printer system (not shown) when a predetermined position of a carriage on which the ink jet pens are mounted is reached. Receipt by SelectInit 702 of the FireRise signal is indicated in block diagram of FIG. 7.

Once the FireRise signal is received, SelectInit 702 starts a new timeslot, as indicated in block 802. In this context, a timeslot is the period of time during which a sequence of select pulses is sent out on the external select lines to the ink pens. As described below, that sequence can include each of the select lines or a subset thereof. Regardless, each timeslot corresponds to a unique combination of addresses of the ink jet pens. Multiple timeslots may be required to fire each of the nozzles of an ink pen.

SelectInit 702 begins the new timeslot by loading its associated timer, SelectTimer1, as indicated in block 804. Specifically, SelectInit 702 loads the SelectTimer1 to track the on or "high" time that establishes the duration of time during which a pulse will be sent out by SelectInit on the first select line, Select0, or the duration of time SelectInit will remain idle, depending upon what value is stored in the select pulse enable register, SelPulseEn, for Select0. With reference to FIG. 7, SelectInit 702 can load SelectTimer1 708 by sending a LoadSelPW1 signal to SelectTimer1.

With reference to block 806 of FIG. 8A, SelectInit 702 further consults SelPulseEn to determine whether a pulse is or is not to be sent out on Select0. Such consultation is indicated by signal SelPulseEn that feeds into SelectInit 702 in FIG. 7. At this point, flow depends upon whether a pulse is or is not indicated for Select0, as indicated in decision block 808. If a pulse is indicated, for example if the first bit of SelPulseEn is a "1," SelectInit 702 sends out a pulse on Select0 for the high time counted by SelectTimer 1 708, as indicated in block 810. In such a case, overlap operation is enabled such that a select pulse will be sent out on Select0 at the same time a previous last select pulse (if any) was sent out on the last select line, e.g., Select6. As indicated in FIG. 7, such a pulse can be sent out by SelectInit 702 sending a signal Sel[0] to SelectControl 704 that indicates to SelectControl to send out a pulse on Select0. If a pulse is not indicated, for example if the first bit of SelPulseEn is a "0," SelectInit 702 instead pauses operation (idles) for the duration of the high time counted by SelectTimer1 708, as indicated in block 812. In either case, the high time is counted down by SelectTimer1 708 and expiration of that time period is signaled to SelectInit 702 by SelectTimer1 708. Such a signal is indicated as CntDone1 in FIG. 7.

After a pulse has been sent out (block 810) or not sent out (block 812) on Select0 depending upon the value stored for Select0 in SelPulseEn, SelectInit 702 sends an initiate or trigger signal to SelectControl 704, as indicated in block 814. Such a signal is indicated as TrgSelCont in FIG. 7.

Referring next to block 816 of FIG. 8B, SelectControl 704 receives the trigger signal from SelectInit 702. SelectControl 704 then loads an off or "low" time into its associated timer, SelectTimer2 710, as indicated in block 818. As depicted in FIG. 7, SelectTimer2 710 can be so loaded using a signal LoadSelStgr2. As indicated in block 820, SelectControl 704 further initiates SelectPointer 706. Such a signal is indicated by signal LoadSelPtr in FIG. 7. As mentioned above, SelectPointer 706 refers to SelPulseEn (indicated by signal SelPulseEn feeding into SelectPointer in FIG. 7) to determine which of the remaining select lines, for example, Select1-Select6, are to receive pulses. Therefore, as indicated in block 822 of FIG. 8B, the SelectPointer 706 consults SelPulseEn and identifies the number of a select line on which a pulse should next be sent by SelectControl 704. If SelectControl 704 was just initiated, that select line would be, for example, Select1. SelectPointer 706 can identify or "point" to the various select lines in a variety of different ways. In one embodiment, SelectPointer 706 first determines the total number select pulses indicated by SelPulseEn and then increments through SelPulseEn until it locates a "1." SelectPointer 706 then indicates that a pulse should be sent out on the corresponding select line to SelectControl 704. Such an indication can be conveyed, for example, using signal SelPtrCtr in FIG. 7.

Referring to decision block 824 of FIG. 8B, it is determined whether the low time countdown is complete. As indicated in FIG. 7, completion of the low time can be signaled to SelectControl 704 using signal STGRDone2. If the low time has not completed, flow continues to block 826 of FIG. 8B at which SelectControl 704 awaits low time completion. Once the low time has completed, however, flow continues to block 828 at which SelectControl 704 loads the high time into SelectTimer2 710. As indicated in FIG. 7, SelectTimer2 can be so loaded using a signal LoadSelPW2. SelectControl 704 then sends out a pulse on the select line pointed to by SelectPointer 706 for the high time counted down by SelectTimer2 710, as indicated in block 830. Expiration of the high time can, as indicated in FIG. 7, be indicated by signal CntDone2.

At this point, flow is determined by whether all but the last select line has been accounted for, as indicated in block 832. For example, if there are seven select lines, Select0-Select6, and a select pulse has just been sent out on Select5 (or not sent depending upon the value stored in SelPulseEn for Select5), the second-to-last pulse has been accounted for and SelectControl 704 has acted in relation to all but the last select line, Select6. If that point has not been reached, flow returns to block 818 at which the sequence described in the foregoing is repeated for the next select line. If SelectControl 704 has acted in relation to the second-to-last select line, whether it sent a pulse on the line or omitted to send a pulse on the line in accordance with SelPulseEn, flow continues on to block 834 of FIG. 8C at which SelectControl 704 loads a further low time into SelectTimer2 (block 834) and initiates SelectPointer 706 (block 836). If the low time has counted down (block 838), SelectControl signals SelectInit 702 that all but the last select pulse has been completed (block 842). Such a signal is identified as SelCntlRdy in FIG. 7. At this point, flow simultaneously continues to block 844 of FIG. 8C and back to block 800 of FIG. 8A so that overlap operation is enabled and, if indicated by SelPulseEn, select pulses can be sent out by both SelectInit 702 (e.g., on Select0) and SelectControl 704 (e.g., on Select6). It is noted that the pulses sent out by SelectInit 702 and SelectControl 704 may not necessarily precisely overlap in time. For example, such pulses will not overlap in cases in which the last select pulse completes before the FireRise signal. However, the flow described above enables select pulses to be sent by both SelectInit 702 and SelectControl 704 at or near the same time (i.e., substantially simultaneously). Such operation is considered to comprise "overlap" as the term is used herein.

Continuing with FIG. 8C, SelectControl 704 loads the high time into SelectTimer2 (block 844) and sends out a select pulse on Select6 (block 846). SelectControl 704 then awaits a new initiation signal from SelectInit 702, as indicated in block 848. At or near the same time, SelectInit 702 receives the completion signal from SelectControl 704, thereby indicating to SelectInit that it is again time to send (or not send) a pulse out on Select0. Therefore, flow returns to block 800 at which the next FireRise signal is received by SelectInit 702 and, assuming a pulse is to be sent, a select pulse is sent out by the SelectInit on Select0. This time, however, the sending of the pulse on Select0 generally coincides with the sending of the pulse on the last select line (e.g., Select6) by SelectControl 704, such that the two pulses substantially overlap in time with each other.

In the foregoing description, an example was considered in which two different ink jet pens are operated at the same time, a first pen having 7 select lines (e.g., color pen) and a second pen having only 5 select lines (e.g., black pen). With such control, the second pen sits idle during the additional select time used to send pulses on the first and last select lines of the first pen. It is noted, however, that operation can be optimized for the second pen when the first pen is not needed. Therefore, if a page or a portion of a page is only to be printed in black ink, and the second pen is the black ink pen having only 5 internal select lines, operation can be optimized by zeroing out the bits of SelPulseEn that are not used by that pen. For example, the select pulse enable register can be set such that SelPulseEn='b011_1110 so that select pulses are only generated for Select1, Select2, Select3, Select4, Select5 of 7 total select lines. This increases print speed. In particular, if a "0" is stored for a given select line (e.g., Select 0 and Select6), SelectInit 702 and/or SelectPointer 706 skips that line such that the timers do not count down for that line, thereby decreasing the time required to sequence through the select lines.

It is further noted that each select line can be individually controlled depending upon desired pen operation by simply changing the values of SelPulseEn. Therefore, in addition to SelPulseEn='b111_1110 and SelPulseEn='b011_1111, any other combinations of values can be used to achieve a desired result. For example, if it were desired to send select pulses on only on the second, third, and fifth select lines, the select pulse enable register would be set to SelPulseEn='b010_1010.

Although the foregoing has been a description and illustration of specific embodiments of the invention, various modifications and changes thereto can be made by persons skilled in the art without departing from the scope and spirit of the invention as defined by the following claims.

The invention claimed is:

1. A method for controlling a first ink jet pen and a second ink jet pen, the method comprising:

establishing values of a register, the values indicating whether a pulse is or is not to be sent on select lines that extend from a control circuit to the first and the second ink jet pens;

sending a first select pulse on a first select line with a first control module of the control circuit after consultation of the register; and sending a second select pulse on a second select line with a second control module of the control circuit after separate consultation of the register;

wherein the first and second select pulses are sent at substantially the same time to enable overlap of select pulses, wherein the first ink jet pen has a first number of internal select lines, the second ink jet pen has a second number of internal select lines, and the first number of internal select lines is greater than the second number of internal select lines, wherein the register has a plurality of a bits, a number of the plurality of bits being equal to the first number of internal select lines.

2. The method of claim 1, wherein external select lines extend from the control circuit to both the first and second ink jet pens.

3. The method of claim 1, wherein the select pulses are only sent to the first ink jet pen.

4. A method for controlling ink jet pens, comprising:

providing a control circuit that controls a first ink jet pen and a second ink jet pen with external select lines extending between the control circuit and both the first and second ink jet pens, the external select lines used for both the first and second ink jet pens;

establishing values of a register that indicate whether or not a pulse is to be sent as to each external select line, wherein the values are set such that only a subset of the external select lines can receive select pulses, a number of the external select lines in the subset being less than a first number of internal select lines of the first ink jet pen; and operating the second ink jet pen with the select pulses without operating the first ink jet pen, wherein the second ink jet pen has a second number of internal select lines, and the first number of internal select lines is greater than the second number of internal select lines, wherein the register has a plurality of bits, a number of the plurality of bits being equal to the first number of internal select lines.

5. A control circuit for controlling a first ink jet pen and a second ink jet using external select lines that extend between the control circuit and the ink jet pens and that are shared by the ink jet pens, the control circuit comprising:

a register that stores values, the values indicating whether a pulse is or is not to be sent as to each of the external select lines;

a first control module configured to control select pulses sent on a first external select line after consultation of the register; and a second control module configured to control select pulses sent on a second external select line after consultation of the register, wherein the first ink jet pen has a first number of internal select lines, the second ink jet pen has a second number of internal select lines, and the first number of internal select lines is greater than the second number of internal select lines, wherein the register has a plurality of a bits, a number of the plurality of bits being equal to the first number of internal select lines.

6. The control circuit of claim 5, wherein the first control module is configured to send a select pulse on the first external select line and the second control module is configured to send a select pulse on the second external select line simultaneously when values for the first and second external select lines are set in the register, such that overlapping select pulses are sent.

7. The control circuit of claim 5, wherein the first control module is configured not to send a select pulse on the first external select line when a value for the first external select line is not set in the register, such that overlapping select pulses are not sent.

8. The control circuit of claim 5, further comprising a pointer that consults the register and indicates to the second control module what external select lines are to receive select pulses.

9. The control circuit of claim 5, further comprising a first timer associated with the first control module, the first timer being configured to establish a duration of time during which select pulses are to be sent by the first control module.

10. The control circuit of claim 5, further comprising a second timer associated with the second control module, the second timer being configured to establish a duration of time during which select pulses are to be sent by the second control module.

11. A print system comprising:

a first ink jet pen having a first number of internal select lines;

a second ink jet pen having a second number of internal select lines, the second number being less than the first number;

a control circuit configured to send select pulses to the first and second ink jet pens using a register having a plurality of bits, a number of the plurality of bits equal to the first number of internal select lines; and external select lines that extend from the control circuit to the first and second ink jet pens, the external select lines being shared by the first and second ink jet pens.

12. The print system of claim 11, wherein the first ink jet pen has seven internal select lines.

13. The print system of claim 12, wherein the second ink jet pen has five internal select lines.

14. The print system of claim 13, wherein there are seven external select lines.

15. The print system of claim 11, wherein the control circuit comprises a first control module configured to control select pulses sent on a first external select line and a second control module configured to control select pulses sent on a second external select line.

16. The print system of claim 15, wherein the first control module is configured to send a select pulse on the first external select line and the second control module is configured to send a select pulse on the second external select line simultaneously when values for the first and second external select lines are set in the register, such that overlapping select pulses are sent.

17. The print system of claim 15, wherein the first control module is configured not to send a select pulse on the first external select line when a value for the first external select line is not set in the register, such that overlapping select pulses are not sent.

18. The print system of claim 11, wherein the control circuit further comprises a pointer that consults the register and indicates to the second control module what external select lines are to receive select pulses.

19. The print system of claim 11, wherein the control circuit further comprises a first timer associated with the first control module, the first timer being configured to establish a duration of time during which select pulses are to be sent by the first control module.

20. The print system of claim 11, wherein the control circuit further comprises a second timer associated with the second control module, the second timer being configured to establish a duration of time during which select pulses are to be sent by the second control module.

21. The print system of claim 11, wherein the first ink jet pen is configured for overlap operation in which two of the first number of internal select lines receive pulses at substantially the same time.

22. The print system of claim 21, wherein the second ink jet pen is not configured for overlap operation such that the second number of internal select lines of the second ink jet pen do not receive pulses at substantially the same time.

23. The print system of claim 11, wherein the control circuit is further configured to send out a number of pulses that is less than a number of the external select lines.

* * * * *